US007578386B2

(12) United States Patent
Im

(10) Patent No.: US 7,578,386 B2
(45) Date of Patent: Aug. 25, 2009

(54) COVER ASSEMBLY ENABLE TO MIX INTERIOR MATERIAL AT OPENING

(76) Inventor: Hyo Bin Im, 110-1001 Daerim Apt., Mujigaemaeul, Dang-Dong, Gunpo, Gyeonggi-do, 435-010 (KR)

( * ) Notice: Subject to any disclaimer, the term of this patent is extended or adjusted under 35 U.S.C. 154(b) by 180 days.

(21) Appl. No.: 11/570,588

(22) PCT Filed: Jun. 30, 2005

(86) PCT No.: PCT/KR2005/002054

§ 371 (c)(1),
(2), (4) Date: Dec. 13, 2006

(87) PCT Pub. No.: WO2006/004345

PCT Pub. Date: Jan. 12, 2006

(65) Prior Publication Data

US 2008/0035497 A1 Feb. 14, 2008

(51) Int. Cl.
*B65D 25/08* (2006.01)

(52) U.S. Cl. ..... 206/221; 215/DIG. 8

(58) Field of Classification Search ..... 206/222, 206/219, 145, 568, 221; 222/417, 449, 454; 141/22, 320, 321, 322; 215/DIG. 8
See application file for complete search history.

(56) References Cited

U.S. PATENT DOCUMENTS

| | | | | |
|---|---|---|---|---|
| 4,513,861 | A | 4/1985 | Baram | |
| 5,884,759 | A | 3/1999 | Gueret | |
| 6,533,113 | B2 * | 3/2003 | Moscovitz | 206/222 |
| 6,908,011 | B2 * | 6/2005 | Cho | 222/83 |
| 6,994,211 | B2 * | 2/2006 | Cho | 206/221 |
| 2002/0053524 | A1 * | 5/2002 | Alticosalian | 206/219 |

FOREIGN PATENT DOCUMENTS

| | | | |
|---|---|---|---|
| DE | 29916436 | U1 * | 2/2001 |
| EP | 0093090 | | 11/1983 |
| EP | 0133293 | | 2/1985 |
| EP | 0382089 | | 8/1990 |
| KR | 20-0311636 | | 4/2003 |

* cited by examiner

*Primary Examiner*—Byron P Gehman
*Assistant Examiner*—Ernesto A Grano
(74) *Attorney, Agent, or Firm*—IPLA P.A.; James E. Bame

(57) ABSTRACT

A cover coupled with a container that allows contents thereof to be mixed when the cover is opened, is provided. The cover includes a cover body and a packing member. The cover body consists of a cylinder-shaped shaped receiving wall integrally projected from the bottom to for a receiving space. The packing member has a blocking wall, the first support wall, the second support wall, and bridges. The first support wall extends from the blocking wall and is forcibly fitted in the inside of the receiving wall. The second support wall is forcibly fitted in the inside of the lateral wall of the container and the bridges are formed at a constant interval to connect the first support wall and the second support wall. Since the cover body and the packing member are coupled in the shape of an assembly, a coupling process with the container can be separately performed and thus assembling efficiency improves.

8 Claims, 3 Drawing Sheets

[Fig. 1]
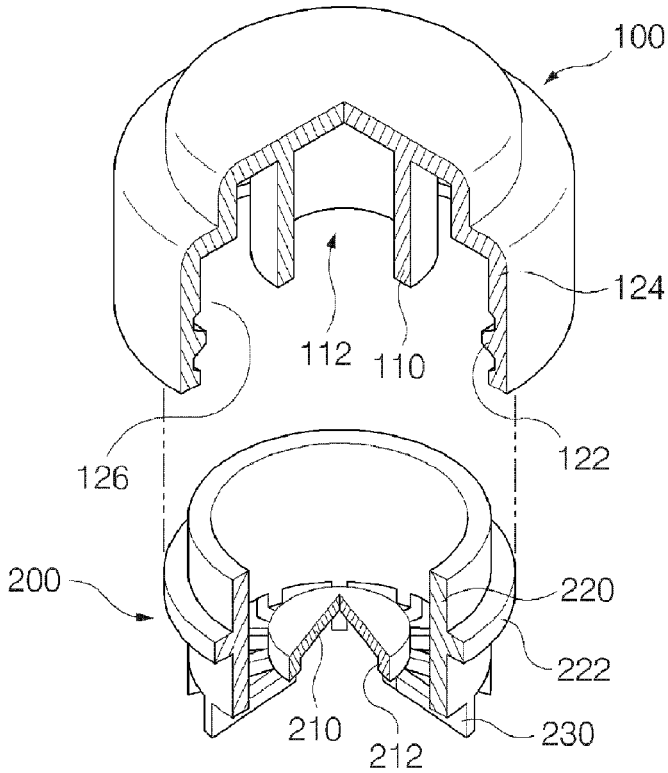
[Fig. 2]
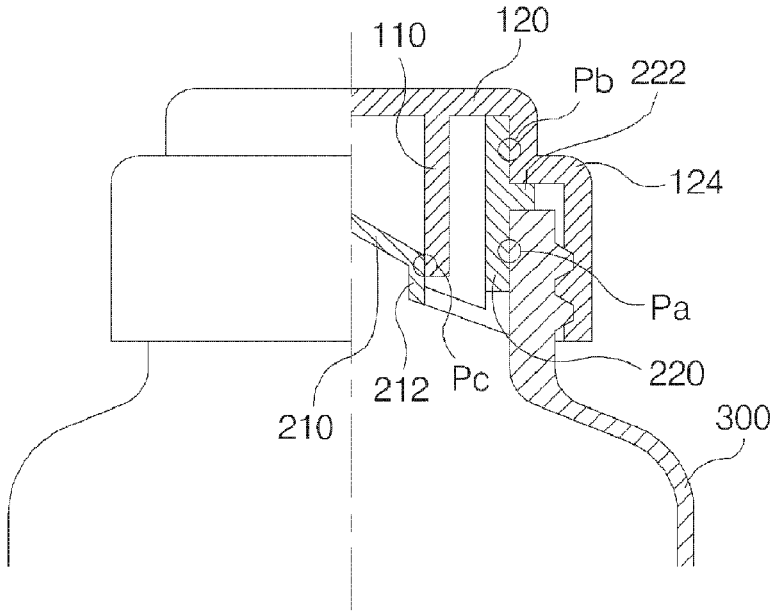

[Fig. 3]
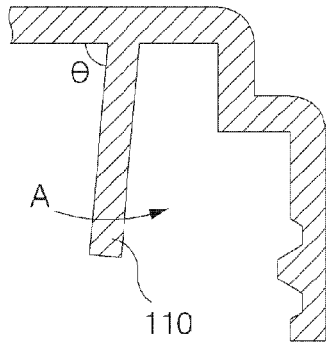
[Fig. 4]
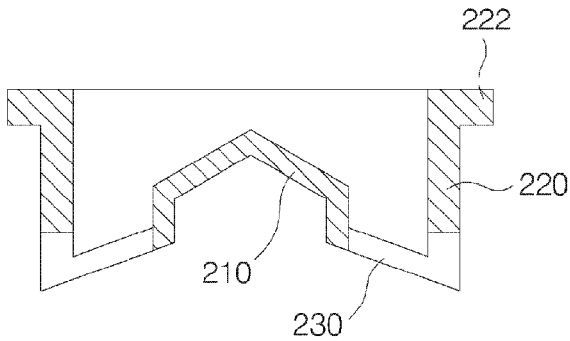
[Fig. 5]
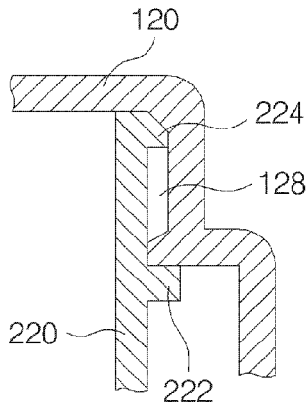

[Fig. 6]
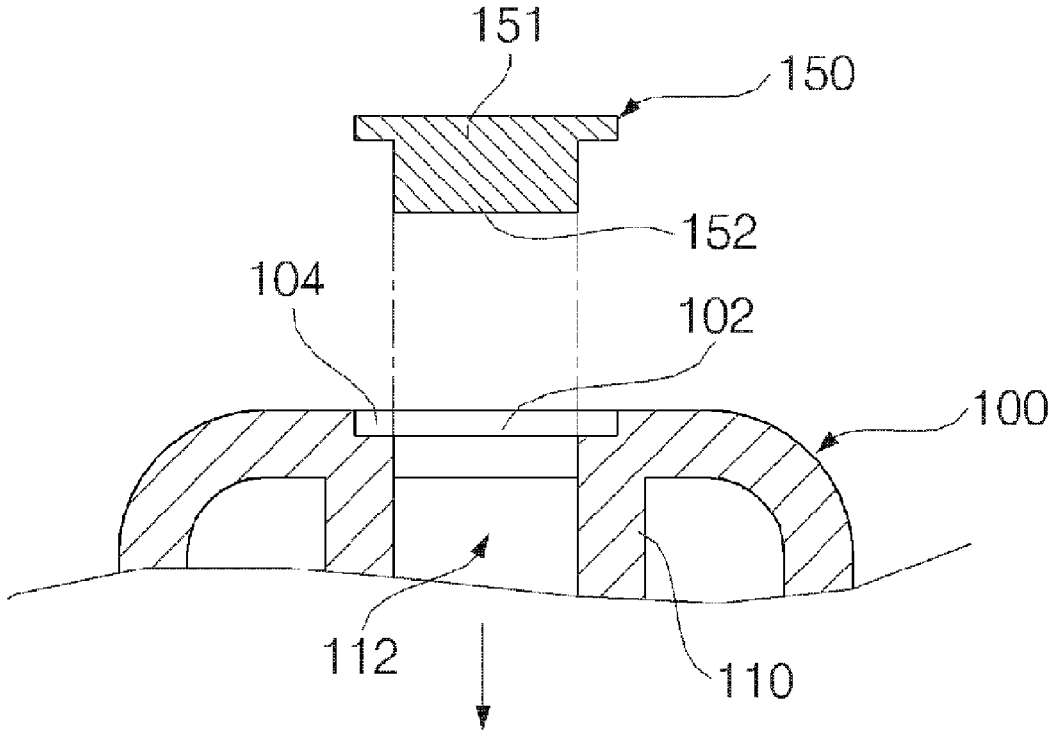

COVER ASSEMBLY ENABLE TO MIX INTERIOR MATERIAL AT OPENING

TECHNICAL FIELD

The present invention relates to a cover that can allow different contents to be mixed when the cover is opened, and more particularly to a cover capable of improving assembling efficiency by allowing the cover to be coupled with a container with a cover body and a packing member assembled in advance. Also, the present invention relates to a cover having a simple structure and allowing a packing member to be attached to a container and remain in or to be attached to the cover and detached together with, if necessary, when the cover is opened.

BACKGROUND ART

A container containing beverage or cosmetics generally includes one type of content. Therefore, the container has a simple structure consisting of a container having a receiving space for receiving such a content and a cover for sealing the container.

However, as functional beverage or cosmetics appear, a necessity for a container structure allowing different contents to be mixed when the drinking water or cosmetics are used by a consumer has emerged.

The structure proposed by such a necessity will now be described. A packing member is generally used so as to store a content added to the content of the container. When a cover sealing the container is opened, the packing member is detached from the container and falls into a receiving space inside the container.

When the packing member exists inside the container, it is problematic that many troubles are caused in using the contents of the container. Also, since the packing member fails to subside to the lower portion of the container in the case of sol-type contents, the packing member may block a path through which the content flows out of the container.

Also, in the case of beverage, there is a danger that the packing member gets into the mouth of a user together with the beverage.

Though constructions for solving the above problems have been suggested, the constructions are very complicated and thus lots of parts are used, which increases manufacturing costs.

Also, in association with the complicated construction, assembling efficiency deteriorates because the assembling is performed in an order that the packing member is mounted on the container first and then the cover is coupled thereto.

DISCLOSURE OF INVENTION

Technical Problem

An object of the present invention is to provide a cover for preventing a partition member from getting into a receiving space inside a container when the cover of the container is opened, the partition member partitioning at least two different contents.

Another object of the present invention is to provide a cover for improving assembling efficiency by allowing the cover to be assembled to a container after a cover body and a packing member are incorporated into one assembly.

A further object of the present invention is to provide a cover capable of reducing manufacturing costs by providing a simple structure.

Technical Solution

To achieve these and other advantages and in accordance with the purpose of the present invention, as embodied and broadly described, there is provided a cover including: a cover body having a bottom and a lateral wall integrally formed at edges of the bottom and a cylinder-shaped receiving wall integrally projected from the bottom to form a receiving space for receiving contents in an inside of the lateral wall; and a packing member having a blocking wall for closing the receiving space, a first support wall extending from the blocking wall and forcibly fitted in an inside of the receiving wall, a second support wall forcibly fitted in an inside of a neck of a container, and bridges formed at a constant interval to connect the first support wall with the second support wall.

According to another aspect of the present invention, there is provided a cover including: a cover body having a bottom and a lateral wall integrally formed at edges of the bottom, and having a cylinder-shaped receiving wall integrally projected from the bottom to form a receiving space for receiving contents in an inside of the lateral wall, and the cover body having a bent portion formed at a predetermined position of the lateral wall and bent in a step shape; and a packing member having a blocking wall for closing the receiving space, a first support wall extending from the blocking wall and forcibly fitted in an inside of the receiving wall, a second support wall forcibly fitted in an inside of a neck of a container, and bridges formed at a constant interval to connect the first support wall with the second support wall, a sealing member fitted between the bent portion and an end of a container along an outer periphery of the second support wall being projected from a predetermined position of the second support wall.

According to further another aspect of the present invention, there is provided a cover including: a cover body having a bottom and a lateral wall integrally formed at edges of the bottom and a cylinder-shaped receiving wall integrally projected from the bottom to form a receiving space for receiving contents in an inside of the lateral wall; and a packing member having a blocking wall for closing the receiving space, a first support wall extending from the blocking wall and forcibly fitted in an inside of the receiving wall, a second support wall forcibly fitted in an inside of a neck of a container, and bridges formed at a constant interval to connect the first support wall with the second support wall, a hooking protuberance being formed at an end of the second support wall, a guide groove that has a predetermined width and depth being formed to a height direction in an inside of the lateral wall of the cover body, the guide groove facing the hooking protuberance such that movement of the hooking protuberance is restricted by the guide groove.

According to yet another aspect of the present invention, there is provided a container assembly including: the above-described cover; and a container coupled with the cover.

The blocking wall may be inclined to have an apex in an inside of the receiving space and the receiving wall is defined to form an acute angle toward the receiving space with respect to the bottom.

Advantageous Effects

According to the present invention, since the packing member does not fall into the inside of the container when the cover is separated from the container, the container is convenient to use, and particularly, in the case where the present invention is applied to a container for beverage that a child drinks, there is no possibility that the packing member falls into the throat of a child, so that safety can be secured.

Also, the cover body and the packing member are coupled with each other in the form of an assembly first and then a coupling process with the container can be separately performed, so that assembling efficiency improves.

Also, since the present invention has a simple structure consisting of the cover body and the packing member, a manufacturing cost is lowered.

BRIEF DESCRIPTION OF THE DRAWINGS

The above objects, other features and advantages of the present invention will become more apparent by describing the preferred embodiments thereof with reference to the accompanying drawings, in which:

FIG. 1 is a partially cut-off exploded perspective view of a cover according to one embodiment of the present invention;

FIG. 2 is a sectional view illustrating the cover of FIG. 1 is coupled with a container;

FIG. 3 is a sectional view of a receiving wall in the cover of the present invention;

FIG. 4 is a sectional view illustrating a modification of the second support wall of a packing member in the cover of the present invention;

FIG. 5 is a sectional view illustrating another embodiment of the present invention; and FIG. 6 is a sectional view illustrating yet another embodiment of the present invention.

BEST MODE FOR CARRYING OUT THE INVENTION

Reference will now be made in detail to the preferred embodiments of the present invention, examples of which are illustrated in the accompanying drawings.

First Embodiment

FIG. 1 is a partially cut-off exploded perspective view of a cover according to one embodiment of the present invention and FIG. 2 is a sectional view illustrating the cover of FIG. 1 is coupled with a container.

A cover body 100 includes a bottom and a lateral wall integrally formed at the edges of the bottom and includes a cylinder-shaped receiving wall 110 integrally projected from the bottom of the cover body 100 to form a receiving space 112 for receiving contents in the inside of the lateral wall.

Though the lateral wall of the cover body 100 is formed to have a bent portion 124 bent in a step shape, the bent portion has been added to describe a preferred shape, so the bent portion don't need to be necessarily provided.

The height of the receiving wall 110 is not limited but it is not desirable that the height of the receiving wall 110 is projected further than the cover body 100. Also, referring to FIG. 3, the receiving wall 110 can be formed to make an acute angle ? toward the receiving space 112 with respect to the bottom of the cover body 100 and can be inclined to have constant restoring force as illustrated by an arrow A.

The packing member 200 constitutes a cylinder shape as a whole and includes a blocking wall 210 for closing the receiving space 112 formed by the receiving wall 110, a first support wall 212 extending from the blocking wall 210 and forcibly fitted in the inside of the receiving wall 110, the second support wall 220 forcibly fitted in the inside of a neck of the container, and bridges 230 formed at a constant interval to connect the first support wall 212 with the second support wall 220.

The blocking wall 210 has a funnel shape inclined to have an apex in the inside of the receiving space 112 and can allow the contents received in the receiving space 112 to slide down by a weight of their own.

Forming the bridges 230 at a constant interval is intended for providing paths through which the contents received in the receiving space 112 can pass and fall into the inside of the container.

The outer diameter of the first support wall 210 can be the same as or greater than the inner diameter of the receiving wall 110 so that the first support wall 210 may be forcibly fitted in the receiving wall 110. Likewise, the outer diameter of the second support wall 220 can be the same as or greater than the inner diameter of the neck of the container so that the second support wall 210 may be fitted in the neck of the container.

At this point, it is possible to allow the packing member 200 to be attached to the container and remain thereon when the cover is separated from the container by making a coupling degree between the second support wall 220 and the neck of the container larger than a coupling degree between the first support wall 210 and the receiving wall 110. For that purpose, as described above, dimension can be adjusted or the area of the coupled portion can be adjusted.

The height of the second support wall 220 may extend to contact the inside of the lateral wall of the cover body 100 as illustrated in FIG. 1, or may be also made short so as not to contact the inside of the lateral wall of the cover body 100 as illustrated in FIG. 4.

A sealing member 222 fitted between the bent portion 124 formed in the lateral wall of the cover body 100 and the end of the container can be projected from a predetermined position of the second support wall 220 along the outer periphery of the second support wall 220.

The sealing member 222 is formed as described above, so that airtightness can improve when the cover is coupled with the container.

In operation, the receiving space 110 is filled with contents by a content-supply device (not shown) with the cover body 100 turned over. The contents may be used in the form of powder, a tablet, or liquid.

Subsequently, the packing member 200 is picked up using an appropriate jig (not shown) and coupled with the cover body 100.

Referring to FIG. 2, the first support wall 212 gets into the receiving space 112 in the inside of the receiving wall 110 and forcibly fitted in the receiving wall 110. At this point, as described above, when the receiving wall 110 is formed to make an acute angle ? toward the receiving space 112 with respect to the bottom of the cover body 100, the first support wall 212 is firmly sealed and fixed by restoring force of the receiving wall 110 after forcibly fitted in the receiving wall 110. In that case, if necessary, the end of the receiving wall 110 can be formed in a taper shape to allow the first support wall 212 to be swiftly fitted in the receiving wall 110.

Also, in the case where the second support wall 220 extends to contact the inside of the lateral wall of the cover body 100, a coupling state can be maintained more firmly by the coupling between the first support wall 212 and the receiving wall 110 and the coupling between the second support wall 220 and the lateral wall of the cover body 100. Particularly, in this case, leakage of the contents can be prevented even though the coupling between the first support wall 212 and the receiving wall 110 is loosened.

An assembly in which the cover body 100 is coupled with the packing member 200 as described above is coupled with the container 300.

At this point, the second support wall 220 is forcibly fitted in the inside of the lateral wall of the container 300 and a coupling degree Pa between them is greater than a coupling degree Pc between the first support wall 212 and the receiving wall 110. Also, in some cases, the coupling degree between the second support wall 220 and the inside of the lateral wall of the container 300 is greater than the sum of the coupling degree Pc between the first support wall 212 and the receiving wall 110 and the coupling degree Pb between the second support wall 220 and the lateral wall of the cover body 100.

In the case where the sealing member 222 is provided, the sealing member 222 is interposed between the bent portion 124 and the end of the container 300 to improve airtightness.

Since the cover body 100 and the packing member 200 are coupled in the form of an assembly first and then a coupling process with the container can be separately performed, assembling efficiency improves. Particularly, since the present invention has a simple structure consisting of the cover body and the packing member, a manufacturing cost is reduced.

When the cover body 100 is separated from the container 300 in the coupling state, since the coupling degree Pa between the second support wall 220 and the lateral wall of the container 300 is greatest, the cover body 100 is raised with respect to the container 300 and the coupling between the first support wall 212 and the receiving wall 110 is released, and the contents received in the receiving space 112 flow down from the blocking wall 210 and fall into the inside of the container 300 through spaces between the bridges 230.

When the cover body 100 is completely separated from the container 300, only the packing member 200 is attached to the container 300 and remains thereon.

Second Embodiment

FIG. 5 is a sectional view illustrating another embodiment of the present invention.

The second embodiment illustrates a construction in which a packing member 200 is detached with being attached to a cover body 100 when the cover body 100 is separated from a container 300.

That is, a hooking protuberance 224 is projected from the end of the second support wall 220 and a guide groove 128 having a predetermined width and depth and facing the hooking protuberance 224 is formed in the inside of the lateral wall of the cover body 100.

Therefore, the hooking protuberance 224 is restricted in its movement by the guide groove 128. When the cover body 100 is detached from the container 300, the packing member 200 is also detached from the container 300 with the hooking protuberance 224 hooked at the guide groove 128.

Third Embodiment

FIG. 6 is a sectional view illustrating yet another embodiment of the present invention.

In the third embodiment, a through hole 102 for communicating with a receiving space 112 is formed in the bottom of a cover body 100 and the through hole 102 is sealed using a sealing member 150.

In the third embodiment, the sealing member 150 includes a holding part 151 and a sealing part 152 having different diameters, respectively, and a support groove 104 is formed around the entry of the through hole 102 in response to the edge of the sealing part 152 so that the sealing member 150 may form the same surface as that of the cover body 100.

According to the third embodiment, with the packing member 200 coupled with the cover body 100 already, a receiving space 110 is filled with contents from the upper portion of the cover body 100 and then the cover body 100 can be sealed using the sealing member 150.

Though the present invention has been described mainly for the preferred embodiment thereof, various changes and modifications would be obvious to those skilled in the art.

For example, the receiving wall may be formed in a cylindrical shape or a polygonal box shape and the number of the bridges may be appropriately selected.

Although the preferred embodiments of the present invention have been disclosed for illustrative purpose, those skilled in the art will appreciate that various modifications, additions and substitutions can be made without departing from the scope and spirit of the invention as defined in the accompanying claims.

The invention claimed is:

1. A cover coupled with a container, the cover as being opened allowing different contents to be mixed, the cover comprising:

a cover body having a bottom and a lateral wall integrally formed at edges of the bottom, and having a cylinder-shaped receiving wall integrally projected from the bottom to form a receiving space for receiving the contents in an inside of the lateral wall, wherein the cylinder-shaped receiving wall is not higher than the lateral wall; and a packing member having a blocking wall for closing the receiving space, a first support wall extending from the blocking wall and forcibly fitted in an inside of the receiving wall with a first coupling degree, a second support wall forcibly fitted in an inside of a neck of the container with a second coupling degree, and bridges formed at a constant interval to connect the first support wall with the second support wall, wherein the second coupling degree is greater than the first coupling degree.

2. The cover of claim 1, wherein the blocking wall is inclined to have an apex in an inside of the receiving space.

3. The cover of claim 1, wherein the receiving wall is defined to form an acute angle toward the receiving space with respect to the bottom.

4. The cover in claim 1, further comprising: a through hole formed in a bottom of the cover body and communicating with the receiving space, the through hole being sealed by the sealing member.

5. A cover coupled with a container, the cover as being opened allowing different contents to be mixed, the cover comprising:

a cover body having a bottom and a lateral wall integrally formed at edges of the bottom, and having a cylinder-shaped receiving wall integrally projected from the bottom to form a receiving space for receiving the contents in an inside of the lateral wall, and the cover body having a bent portion formed at a predetermined position of the lateral wall and bent in a step shape; and a packing member having a blocking wall for closing the receiving space, a first support wall extending from the blocking wall and forcibly fitted in an inside of the receiving wall with a first coupling degree, a second support wall forcibly fitted in an inside of a neck of a container with a second coupling degree, and bridges formed at a constant interval to connect the first support wall with the second support wall, a sealing member fitted between the bent portion and an end of the container along an outer periphery of the second support wall being projected from a predetermined position of the second support wall for increasing airtightness when the cover is coupled with the container, wherein a portion of the second support wall is fitted with the bent portion of the lateral wall of the cover body with a third coupling degree, wherein the second coupling degree is greater than the first coupling degree or greater than sum of the first coupling degree and the third coupling degree.

6. The cover in claim 5, further comprising: a through hole formed in a bottom of the cover body and communicating with the receiving space, the through hole being sealed by the sealing member.

7. A cover coupled with a container that allows contents thereof to be mixed when the cover is opened, the cover comprising:

a cover body having a bottom and a lateral wall integrally formed at edges of the bottom and a cylinder-shaped receiving wall integrally projected from the bottom to form a receiving space for receiving the contents in an inside of the lateral wall, wherein the cylinder-shaped receiving wall is not higher than the lateral wall; and a packing member having a blocking wall for closing the receiving space, a first support wall extending from the blocking wall and forcibly fitted in an inside of the receiving wall with a first coupling degree, a second support wall forcibly fitted in an inside of a neck of a container with a second coupling degree, and bridges formed at a constant interval to connect the first support wall with the second support wall, a hooking protuberance being formed at an end of the second support wall, a guide groove that has a predetermined width and depth being formed to a height direction in an inside of the lateral wall of the cover body, the guide groove facing the hooking protuberance such that movement of the hooking protuberance is restricted by the guide groove, wherein the second coupling degree is greater than the first coupling degree.

8. The cover in claim 7, further comprising: a through hole formed in a bottom of the cover body and communicating with the receiving space, the through hole being sealed by the sealing member.

* * * * *